US006350169B1

(12) United States Patent
Holt

(10) Patent No.: US 6,350,169 B1
(45) Date of Patent: Feb. 26, 2002

(54) FINGER PUPPET WITH A TRANSPARENT WINDOW AND TUMMY CAVITY

(75) Inventor: Walter Paul Holt, Hoffman Estates, IL (US)

(73) Assignee: Legends USA, Inc., IL (US)

( * ) Notice: Subject to any disclaimer, the term of this patent is extended or adjusted under 35 U.S.C. 154(b) by 0 days.

(21) Appl. No.: 09/654,537

(22) Filed: Sep. 1, 2000

(51) Int. Cl.[7] ..... A63H 3/14

(52) U.S. Cl. ..... 446/327; 446/376; 446/72; 446/73

(58) Field of Search ..... 446/327, 73, 72, 446/74, 75, 76, 77, 329, 83, 366, 26, 376

(56) References Cited

U.S. PATENT DOCUMENTS

| | | | | | |
|---|---|---|---|---|---|
| 1,445,368 | A | | 2/1923 | Street et al. | |
| 1,513,231 | A | | 10/1924 | English | |
| 3,099,568 | A | | 7/1963 | Brody et al. | |
| D199,907 | S | | 12/1964 | Journer | |
| 3,520,078 | A | | 7/1970 | Klamer | |
| 4,197,670 | A | * | 4/1980 | Cox | 446/369 |
| 4,288,222 | A | | 9/1981 | Kling | |
| 4,504,240 | A | | 3/1985 | Thomas | |
| 4,581,904 | A | * | 4/1986 | Lehmann et al. | 446/376 |
| 4,715,840 | A | | 12/1987 | Swift | |
| 4,762,494 | A | | 8/1988 | Woods | |
| 4,838,827 | A | * | 6/1989 | Schlaifer | 446/327 |
| 4,878,871 | A | * | 11/1989 | Noto | 446/901 |
| 4,917,607 | A | * | 4/1990 | Van Hoose | 446/369 |
| 5,044,959 | A | | 9/1991 | Shaver et al. | |
| 5,059,149 | A | | 10/1991 | Stone | |
| 5,092,778 | A | | 3/1992 | Shaver et al. | |
| 5,386,909 | A | | 2/1995 | Spector | |
| 5,597,339 | A | | 1/1997 | Spector | |
| 5,626,503 | A | * | 5/1997 | Heftel et al. | 446/73 |
| 5,632,377 | A | | 5/1997 | Ferrero | |
| 5,749,764 | A | | 5/1998 | Bailey | |
| D401,347 | S | | 11/1998 | Cosentino | |
| 5,842,900 | A | | 12/1998 | Hodge | |
| 5,888,117 | A | * | 3/1999 | Sutton | 446/369 |

* cited by examiner

*Primary Examiner*—Jacob K. Ackun, Jr.
*Assistant Examiner*—Urszula M. Cegielnik
(74) *Attorney, Agent, or Firm*—Welsh & Katz, Ltd.

(57) ABSTRACT

The invention relates to a puppet comprising a front side, a back side, and a tummy cavity formed within the puppet. A transparent window section is formed on the front side of the puppet and positioned so that a user can view into the tummy cavity. The puppet also includes a finger cavity.

12 Claims, 2 Drawing Sheets

FIG. 1
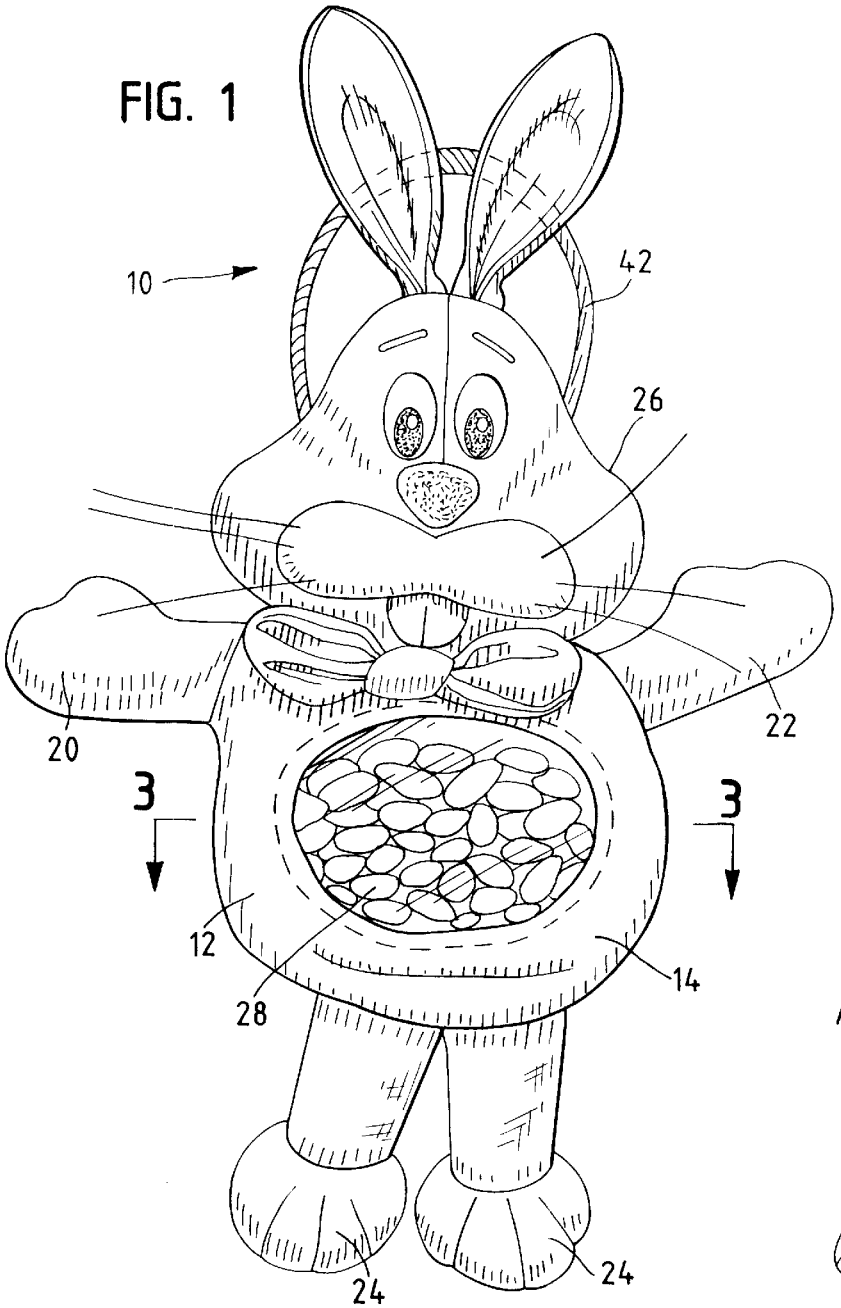
FIG. 2
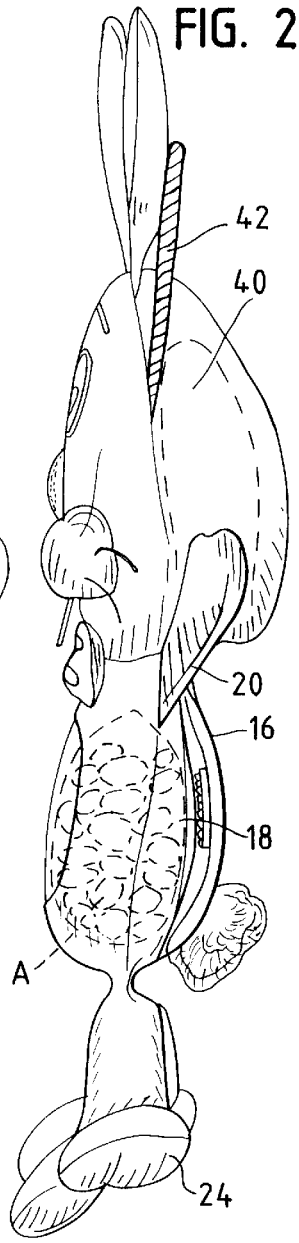
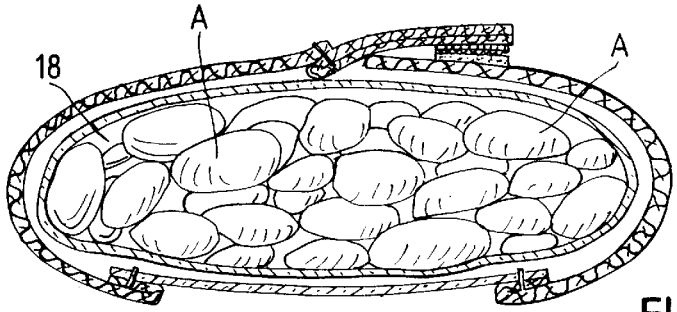
FIG. 3

FIG. 4
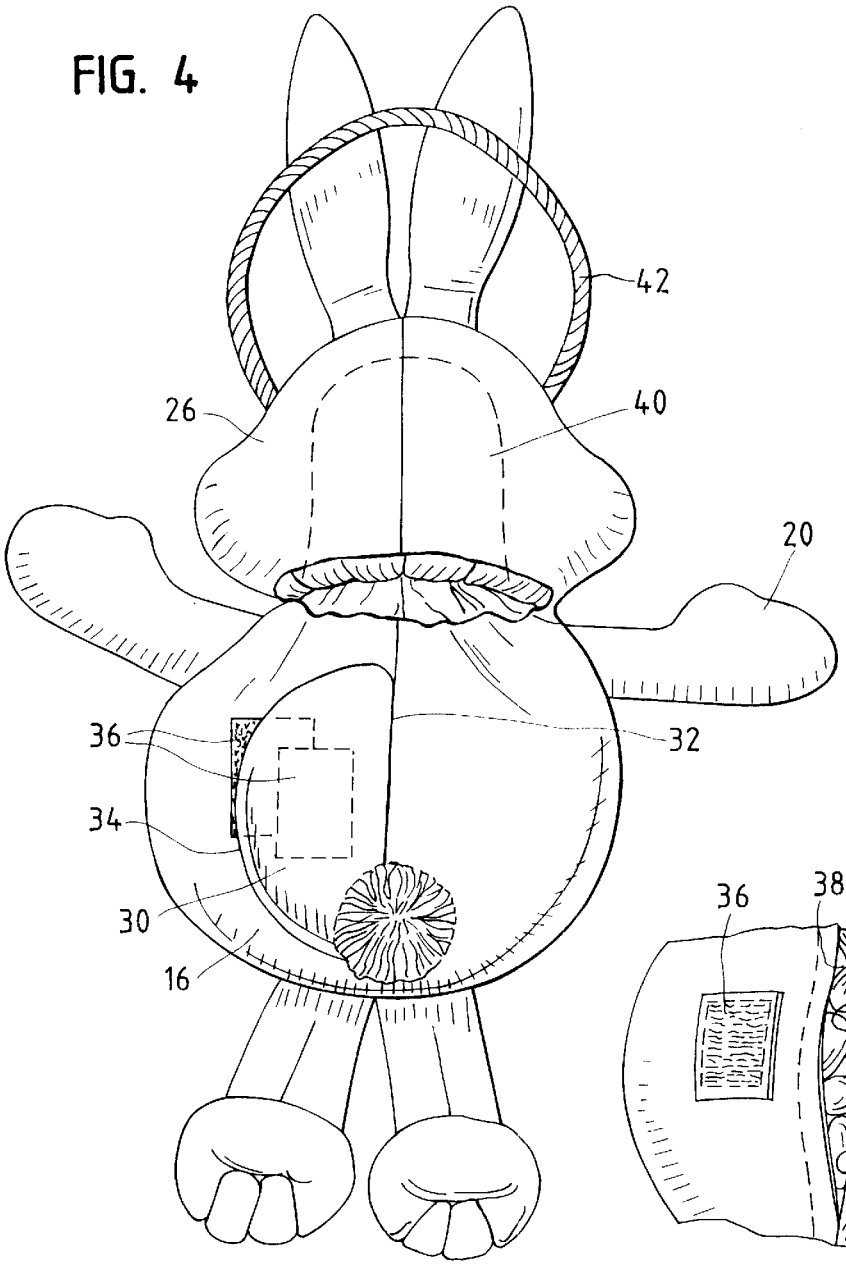
FIG. 5
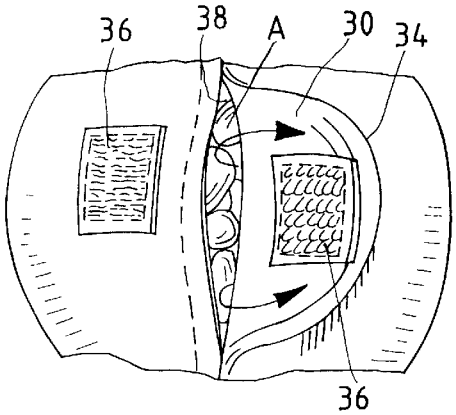
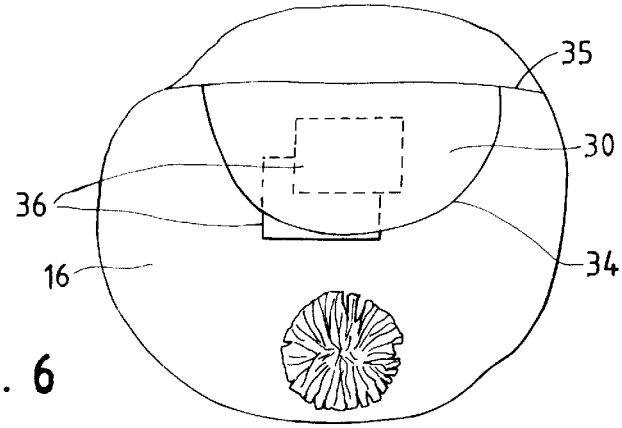
FIG. 6

FINGER PUPPET WITH A TRANSPARENT WINDOW AND TUMMY CAVITY

FIELD OF THE INVENTION

The invention relates to finger puppets. In particular, the invention relates to a usable finger puppet with a tummy cavity that advantageously allows a user to store random articles, such as, for example, candy, marbles, jumping jacks, and the like.

BACKGROUND OF THE INVENTION

It is well known that children enjoy playing with stuffed puppets. Stuffed puppets with hollow cavities formed therein are also known in the art. Such puppets have been used to carry, store or transport random articles.

When small children acquire several articles, as they often do, articles are often misplaced. While attempting to locate a misplaced article, a child must open a flap or unzip a zipper if he or she believes the misplaced article is stored in a stuffed puppet of the prior art. In that small children may have limited manual dexterity, this process may be long and tedious, and may eventually frustrate the child.

In addition, stuffed puppets of prior art have the same 'look' regardless of what articles are stored within the cavity. Children, nonetheless, may find a puppet that can have different 'looks' dependant on the type of articles that are stored within the cavity to be more aesthetically pleasing.

Accordingly, there continues to be a need for a stuffed puppet that allows a child to locate an article without having to open a flap or unhook a hook, and which puppet can have a different 'look' dependant on what articles are stored within the puppet.

SUMMARY OF THE INVENTION

A puppet includes a body portion, and where appropriate, two legs, two arms, and a head portion. The two legs depend downwardly from a bottom side of the body portion. A first arm is connected to a right side of the body portion, a second arm is connected to a left side of the body portion, and a head extends upwardly from a top side of the body portion.

A tummy cavity is formed within the body portion. The puppet includes a transparent window that allows a user to view the contents of the tummy cavity through the window. The tummy cavity is accessible through a slit on a back side of the body portion. The slit is covered by a flap that is connected to the back side of the body portion. The flap can include a closure such as strips of a mechanical hook and loop fastener.

A finger cavity is formed within the head and a strap is connected to the head.

BRIEF DESCRIPTION OF THE FIGURES

FIG. 1 illustrates a front view of an exemplary finger puppet embodying the principles of the invention;

FIG. 2 is a side view of the finger puppet and shows, in phantom lines, a view of random articles stored within an exemplary tummy section, and further shows an exemplary finger cavity;

FIG. 3 is a cross sectional view of the tummy section with random articles stored within the tummy section;

FIG. 4 is a rear view of the exemplary finger puppet and shows an exemplary flap that utilizes a vertical edge and a mechanical hook and loop fastener sealing mechanism, and further shows the finger cavity in phantom lines;

FIG. 5 shows the flap in an open position; and

FIG. 6 shows an alternate embodiment of a flap with a horizontal edge.

DETAILED DESCRIPTION OF THE DISCLOSED EMBODIMENT

While the invention is susceptible to embodiment in various forms, there is shown in the drawings and will hereinafter be described a specific embodiment with the understanding that the present disclosure is to be considered an exemplification of the invention and is not intended to limit the invention to the specific embodiment illustrated.

Referring now to the figures, in particular FIG. 1, there is shown one embodiment of a finger puppet 10 with a transparent window 28. The finger puppet 10 includes a body portion 12 with a tummy cavity 18 (FIG. 2) formed therein. The exemplary puppet 10 has five appendages, including one pair of arms 20, 22, one pair of legs 24, and a head 26. While the illustrated embodiment depicts a rabbit, a bunny, or an Easter bunny, it is to be understood that the invention can assume any animal, object or form, and that all such forms are within the scope and spirit of the invention.

The puppet 10 advantageously incorporates a transparent window 28 to allow a user to view into the tummy cavity 18 (FIG. 2) of the finger puppet 10. The use of such a window 28 allows a user, such as, for example, a child, to determine what articles A are stored within the finger puppet 10, without opening a flap 30 (FIG. 4) on a back side 16 of the puppet 10. This novel feature saves the user's time and energy.

In addition, the use of a transparent window 28 has the desired effect of giving the puppet 10 a unique and different 'look' every time a new article A is stored within the tummy cavity 18 (FIG. 2). For example, when storing articles A such as the illustrated jelly beans within the tummy cavity 18, the puppet 10 can take on one 'look' when red jelly beans are stored within the tummy cavity 18, and a different 'look' when a random assortment of jelly beans are stored within the tummy cavity 18.

In the illustrated embodiment, a front side of the body 14 includes a circular shaped transparent window section 28 that can be, for example, sewed on to the body portion 12. The window section 28 advantageously allows a user to see random articles that can be placed within a tummy cavity 18 of the finger puppet 10, which is shown in FIGS. 2. Those skilled in the art will recognize that the transparent window 28 may take the form of other shapes, such as, for example, an oval, a square, and the like, while still advantageously allowing a user to see into the tummy cavity 18 of the puppet 10.

A back side of the body 16, as illustrated in FIG. 4, includes a flap 30 that is operatively connected to the back side of the body 16. The flap 30 may be pivotally connected to the back side of the body 16 by a vertical edge 32, and may include a semi-circular free edge 34.

It should be noted, however, that the flap 30 can also incorporate edges and free edges of various designs. For example, the flap 30 of FIG. 6 incorporates a horizontal edge 35. Those skilled in the art will recognize that the free edge 34 of the flap 30 can likewise take various forms, such as, for example, part of a rectangle, "semi-oval", and the like.

In other embodiments, as shown in FIGS. 4–6, the flap 30 can pivot along a vertical or horizontal pivot edge 34, 35 of the back side of the body 16 and can be secured to the back side of the body 16 by a securing device or closure 36.

Several securing devices 36 may be utilized to secure the flap 30 to the back side of the body 16, such as, for example, a hook and loop type fastener, a mechanical hook and loop fastener such as a VELCRO® strap, and the like.

As shown in FIGS. 4–5, the flap 30 has a closed and an open position. While in a closed position, the exemplary flap 30 of FIGS. 4–6 can cover a vertical or horizontal slit 38 along the back side of the body portion 16. Preferably, the slit 38 is sufficiently long to provide for easy access to the tummy cavity 18 within the body portion 12 of the puppet 10 when the flap 30 is in an open position.

As shown in FIG. 5, after opening the flap 30 by, for example, unhooking the hook and loop fastener or detaching the flap from the VELCRO® seal, the slit 38 is exposed; this allows a user to place random articles A such as, for example, jelly beans, marbles, and the like within the tummy cavity 18 (FIGS. 2–3), or take random articles A out of the tummy cavity 18.

In another feature of the puppet 10, as shown in FIG. 1, the head 26 of the puppet 10 can be pivotally connected to a top side of the body portion 12. The head 26 can assume various forms depending on what animal, object, or form the puppet assumes. In the illustrated embodiment, as shown in FIG. 1, the puppet 10 takes the form of a bunny, and the head 26 is in the form of a bunny's head.

As seen in FIG. 4, the head 26 is stuffed and has a finger cavity 40 formed therein. The finger cavity 40 is sufficiently wide and long to allow a user to slide one or two fingers into the finger cavity 40. The user, after sliding his/her fingers within the finger cavity 40, can manipulate the finger puppet 10 by bending or "wiggling" his/her fingers to cause the puppet's head 26 to move back and forth.

Preferably, as shown in FIGS. 1 and 4, as appropriate, the pairs of arms and legs 20, 22, 24 are pivotally connected to the body portion 12, allowing the appendages to flap when a user "wiggles" his or her fingers.

The puppet 10, as shown in FIG. 4, can also include a tether or a strap 42 of sufficient length that allows a user to hang the puppet 10 so that the puppet 10 hangs in an upright position. In the illustrated embodiment, the strap 42 is attached to the head 26 of the puppet. Those skilled in the art will recognize that the strap 42 can be attached to other parts of the puppet 10 and have varying lengths while still allowing a user to hang the puppet 10 so that the puppet 10 hangs in an upright position.

From the foregoing it will be observed that numerous modifications and variations can be effectuated without departing from the true spirit and scope of the novel concepts of the invention. It is to be understood that no limitation with respect to the specific embodiments illustrated is intended or should be inferred. The appended claims are intended to cover the disclosure and all such modifications thereof as fall within the scope of the claims.

What is claimed is:

1. A puppet comprising:

a front side, a back side, and a tummy cavity formed within the puppet;

a transparent window section formed on the front side of the puppet and positioned so that a user can view into the tummy cavity;

a slit formed along the back side of the puppet and a flap operatively connected to the back side of the puppet, the flap and the back side of the puppet including a sealing mechanism; and a finger cavity formed within the puppet;

wherein the slit is substantially vertical or horizontal and the flap is configured to be connected to the back side of the puppet by a corresponding substantially vertical edge or horizontal edge, the flap configured to cover the slit when in a closed position; and the puppet further including a body portion, wherein the tummy cavity is formed within the body portion, the finger cavity is formed within a head portion, the flap is pivotally connected to the back side of the puppet, a strap is connected to the head portion, the head portion is pivotally connected to the body portion, a first arm is pivotally connected to the body portion, a second arm is pivotally connected to the body portion, and legs are pivotally connected to the body portion.

2. The puppet of claim 1 wherein the sealing mechanism includes a hook attached to the back side of the puppet and a loop attached to an inner side of the flap.

3. The puppet of claim 1 further including a strap.

4. The puppet of claim 1 wherein the puppet includes a body portion, two legs, a first arm, a second arm, and a head portion, wherein the two legs depend downwardly from a bottom side of the body portion, the first arm is operatively connected to a right side of the body portion, the second arm is operatively connected to a left side of the body portion, and the head portion extends upwardly from a top side of the body portion.

5. The puppet of claim 4 wherein the tummy cavity is formed within the body portion.

6. The puppet of claim 4 wherein the finger cavity is formed within the head portion.

7. The puppet of claim 4 wherein the flap is pivotally connected to a back side of the body portion.

8. The puppet of claim 4 further including a strap, wherein the strap is connected to the head portion.

9. The puppet of claim 4 wherein the head portion is pivotally connected to the body portion.

10. The puppet of claim 4 wherein the first arm is pivotally connected to the right side of the body portion and the left arm is pivotally connected to the left side of the body portion.

11. The puppet of claim 4 wherein the legs are pivotally connected to the body portion.

12. The puppet of claim 4 wherein the transparent window is circular shaped and the flap has a semi-circular free edge.

* * * * *